United States Patent [19]

Shuler

[11] Patent Number: 4,693,344

[45] Date of Patent: Sep. 15, 1987

[54] COLLAPSIBLE CARRY BAG WITH FOUR DISCRETE RIGID END PIECES

[76] Inventor: Steven L. Shuler, 33772B Violet Lantern, Dana Point, Calif. 92629

[21] Appl. No.: 704,493

[22] Filed: Feb. 22, 1985

[51] Int. Cl.[4] ..... A45C 7/00

[52] U.S. Cl. ..... 190/107; 190/111; 190/119; 190/127; 190/903; 383/38

[58] Field of Search ..... 383/38, 97, 127, 907; 190/100, 109, 111, 119, 121, 107, 902, 112, 127, 903

[56] References Cited

U.S. PATENT DOCUMENTS

| | | | |
|---|---|---|---|
| 752,756 | 2/1904 | Christie | 190/114 X |
| 909,325 | 1/1909 | Patch | 190/107 |
| 2,131,583 | 9/1938 | Crotty et al. | 190/111 X |
| 2,136,669 | 11/1938 | Bracken | 190/111 X |
| 2,180,191 | 11/1939 | Bauch | 190/112 X |
| 2,695,085 | 11/1954 | Ritter, Jr. | 190/111 X |
| 2,705,063 | 3/1955 | Torrent | 190/111 |
| 2,925,035 | 8/1947 | Garnett et al. | 190/107 |
| 3,128,854 | 4/1964 | Specht | 383/907 X |
| 3,537,552 | 11/1970 | Noble | 190/111 |
| 4,434,894 | 3/1984 | Lee | 206/526 |
| 4,436,189 | 3/1984 | Bauur | 190/119 X |
| 4,544,051 | 10/1985 | Saltz | 190/124 |

FOREIGN PATENT DOCUMENTS

| | | | |
|---|---|---|---|
| 0039220 | 5/1965 | Fed. Rep. of Germany | 190/107 |
| 1073259 | 3/1954 | France | 190/111 |
| 2354727 | 1/1978 | France | 190/107 |
| 0000635 | of 1883 | United Kingdom | 190/112 |
| 0000311 | of 1898 | United Kingdom | 190/111 |
| 0405442 | 2/1934 | United Kingdom | 190/111 |
| 0727879 | 4/1955 | United Kingdom | 190/107 |

*Primary Examiner*—Stephen Marcus
*Assistant Examiner*—Bryon Gehman
*Attorney, Agent, or Firm*—Walter A. Hackler

[57] ABSTRACT

A foldable carry bag generally includes a flexible outer shell, foldable along a centerline thereof, to enable the bag to be opened to provide easy accessibility to compartments therein which are defined by flexible flaps attached to the outer shell and removably attached by zippers to flexible strips attached to end pieces of the carry bag. The bag is foldable to a flat configuration for storage and has the advantage of providing separate compartments within the bag which are easily accessible for packing and unpacking clothes, as well as arrangement of clothes or articles therein, while at the same time maintaining the lightweight and inexpensive features of conventional carry bags.

7 Claims, 3 Drawing Figures

COLLAPSIBLE CARRY BAG WITH FOUR DISCRETE RIGID END PIECES

The present invention is generally directed to a portable carry bag, and more particularly, directed to a carry bag which may be folded flat, or collapsed, for storage and opened in a suitcase-like manner to enable easy access to one or more compartments within the bag for the insertion and removal of clothing or the like.

Carry bags have been made and used for many years. Generally used for casual luggage, carry bags are typically fabricated from soft fabric or the like, and are generally inexpensive to manufacture, compared to formal luggage.

Generally, carry bags are convenient for storage because of their collapsibility, however, they are lacking in providing readily accessible compartments within the bag to facilitate convenient use by a traveler.

That is, heretofore, carry bags, whether they have a rigid bottom with a soft fabric top, or have a totally flexible outer shell, have an inside compartment that is only accessible through a zippered, or a flapped, slot-type entrance.

These bags cannot be opened to an extended, or exposed configuration, wherein clothes may be easily packed or unpacked, and items within the carry bag viewed without disturbing the entire contents of the bag.

For example, the contents of a carry bag having a generally closed configuration with a zippered entry, can only be determined by peering through the opening or by rummaging through the bag by hand to determine its contents.

Further, most conventional carry bags do not provide more than one compartment for storing and separating clean and soiled clothing. A few of the prior art bags have more than one zippered entrance thereto, with a web separating the bag into two compartments. While providing more than one compartment for separation of clean and soiled clothing, these carry bags still are awkward to use and do not provide easy access to the clothing in the compartments because of the slot-type entry thereto.

Hence, there is a need for a compact foldable storage bag having several compartments therein for the separation of clean and soiled clothing which is openable to a position where such clothing may be viewed and arranged in a convenient manner while the user is packing and unpacking the bag. The present invention not only includes this feature, but also retains the advantage of prior art carry bags in that it is foldable, or collapsible, to a relatively flat position for storage when not in use.

SUMMARY OF THE INVENTION

A carry bag, in accordance with the present invention, generally includes a flexible outer shell, foldable along a centerline thereof and having two longitudinal edges and two transverse edges, with each of the two transverse edges being parallel to one another and to the centerline.

Two end pieces are attached along each of the flexible outer shell longitudinal edges, with each of the end pieces being attached along a first portion of a circumference thereof from the flexible outer shell centerline to one of the flexible outer shell transverse edges. The flexible outer shell is thus foldable along the centerline in order to close the flexible outer shell with the flexible outer shell transverse edges meeting one another upon such closure. A second portion of each end piece circumference meets a corresponding portion of another end piece upon closure of the flexible outer shell, thereby providing a structure capable of enclosing objects.

A pair of flexible flaps, one each being attached to each of the flexible outer shell transverse edges is provided, each flexible flap having sufficient length to extend between the flexible outer shell transverse edge and the centerline. The flexible flaps are movable about the attached flexible outer shell transverse edge from a position extending between the flexible outer shell transverse edge and the centerline to a position extending outwardly from the flexible outer shell transverse axis.

When the flexible flaps extend between the flexible outer shell transverse edge and the flexible outer shell centerline, two separate compartments are formed for segregated storage of, for example, clean and soiled clothing.

The flexible flaps meet one another between the flexible outer shell upon closure thereof, thereby maintaining separation of the two compartments.

However, when the flexible flaps are moved to a position extending outwardly from the flexible outer shell transverse axis, the compartments are readily accessible for the storage and removal of articles.

In order to hold the flexible flaps in the position extending between the flexible outer shell transverse edge and the centerline, a plurality of flexible strips are provided with one being attached to each of the second circumferential portion of the end pieces, and zipper means are provided for releasably attaching the flexible strips to the flexible flaps when the flexible flaps are moved to a position extending between the flexible outer shell transverse edge and centerline.

More particularly, the end pieces are foldably attached to the second circumferential portion, to enable the end pieces to be folded in generally parallel relationship with one another against the flexible outer shell. This enables the carry bag to be folded, or collapsed, to a relatively flat position for convenience of storage.

The end pieces may have a semi-circular shape with the first circumferential portion having an arcuate shape and the second circumferential portion having a generally straight shape. With the end pieces having such semi-circular shape, the carry bag assumes a generally tubular configuration when in a closed position.

A handle may be provided, which includes a flexible cord extending around the flexible outer shell, and having first and second portions extending outwardly from the flexible bag transverse edges for carrying of the carry bag. Latch means may be provided for releasably holding the flexible outer shell transverse edges against one another in a closed position.

To further enhance the convenience of the carry bag, at least one pocket may be provided which is disposed on a side of one or more of the flexible flaps facing an inside surface of the flexible outer shell when the flexible flaps extend between the flexible outer shell transverse edges and the centerline.

Alternatively, the flexible flaps may have a pocket disposed on a side thereof facing outwardly from the outer shell when the flexible flaps extend between the flexible outer shell transverse action and the centerline. In this position, the pockets are accessible when the flexible flaps are zipped to the flexible strips and the flexible outer shell is unfolded to expose the flexible flaps. This has the advantage of allowing accessibility to the pockets for the packing and unpacking of small articles without disturbing the main compartments of the carry bag.

In order to provide some rigidity to the bag when it is in use, the end pieces may be formed from relatively stiff material compared to the flexible outer shell, which may be comprised of a cloth fabric. The use of the relatively stiff end pieces also serves to better define the compartments of the carry bag when it is unfolded for use.

A BRIEF DESCRIPTION OF THE DRAWINGS

The advantages and features of the present invention will appear from the following description when considered in conjunction with the accompanying drawings, in which:

FIG. 1 is a perspective view of a carry bag made in accordance with the present invention generally showing the bag in a closed configuration;

FIG. 2 is a perspective view of the carry bag, in accordance with the present invention, shown in an open, or unfolded configuration, and showing a pair of flexible flaps extending from transverse edges from a flexible outer shell to provide ready access to two compartments of the carry bag formed when the flaps are moved to a position extending between the transverse outer edge of the flexible outer shell and a centerline; and FIG. 3 is a perspective view of the carry bag shown in a folded configuration for storage thereof.

DETAILED DESCRIPTION

Figure 1:
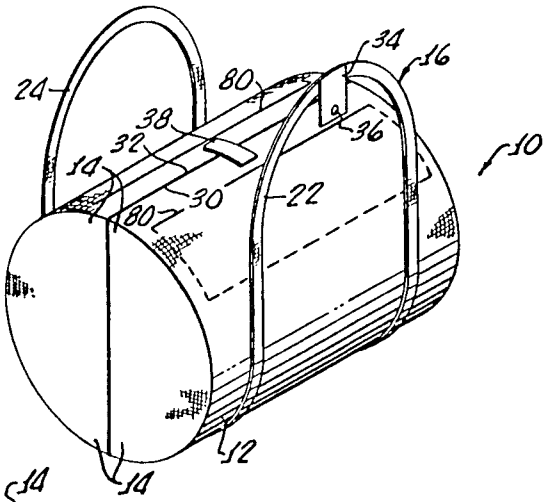

Turning now to FIG. 1, there is shown a carry bag 10, in accordance with the present invention, and generally showing in perspective view a flexible outer shell 12, end pieces 14, as well as a flexible cord 16 extending around the flexible outer shell 12 and having a first and second portion 22, 24 thereof extending outwards from transverse edges 30, 32 for convenient transport of the carry bag 10.

The flexible cord first and second portions 22, 24 may be in the form of a loop, as shown, and generally meet one another when the flexible outer shell 12 is in a closed position as shown in FIG. 1. A tab 34 may be provided with a snap 36 thereon, which may be attached to the first portion 22 of the flexible cord 16 and sized for a wraparound engagement with the second portion 24 of the flexible cord 16, in order to maintain the first and second portions 22, 24 in a meeting position for easy grasping by a user of the carry bag 10.

In addition, a clasp 38 may be provided to hold the carry bag 10 in a closed position.

Figure 2:
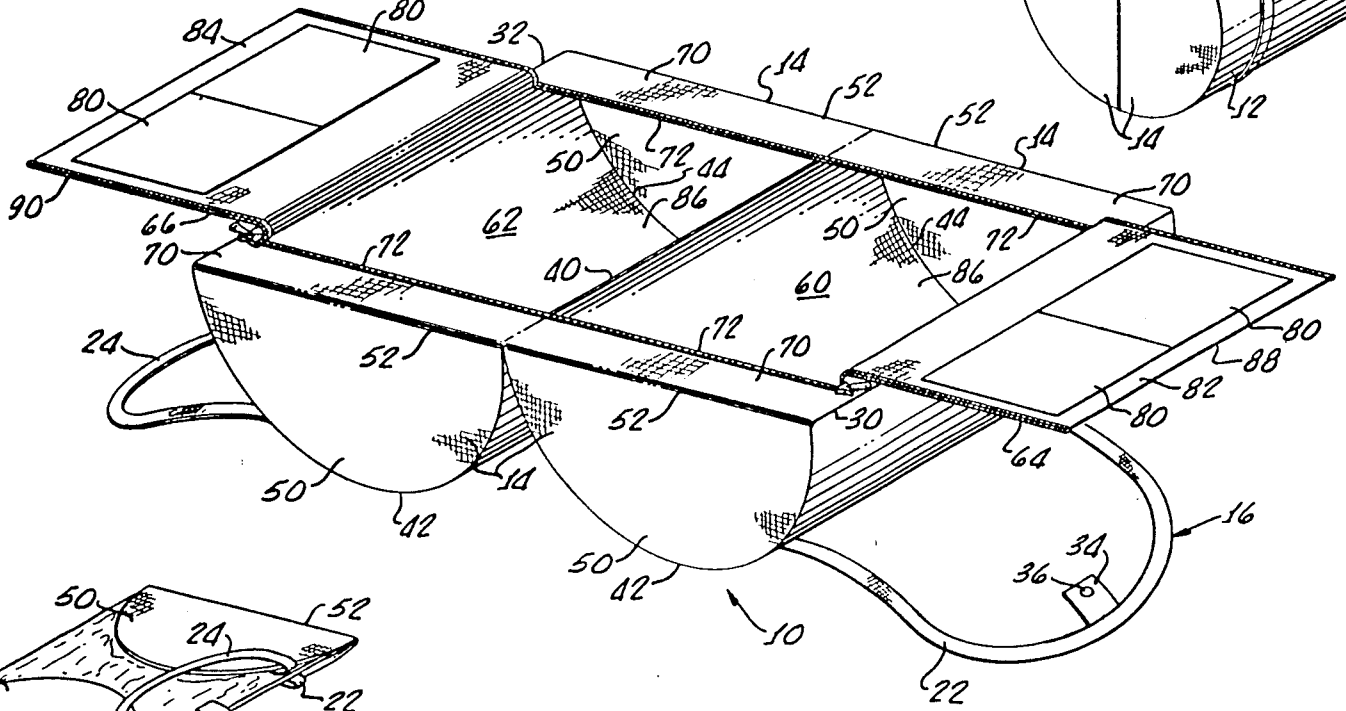

FIG. 2 is a perspective view of the carry bag 10 in an open position for providing easy access for packing and unpacking clothes, personal items, or the like.

As shown, the flexible outer shell 12 is foldable along a centerline 40 thereof and includes two longitudinal edges 42, 44 and the two transverse edges 30, 32 which are generally parallel to one another and to the centerline 40.

The end pieces 14 are attached along each of the flexible outer shell longitudinal edges 42, 44 with two such end pieces 14 being attached to the longitudinal edge 42 and two end pieces 14 being attached to the longitudinal edge 44.

Each of the end pieces 14 are attached along a first portion 50 thereof from the flexible outer shell centerline 40 to one of the flexible outer shell transverse edges 30, 32.

As shown in FIG. 2, the first portion 50 of the circumference of the ends may be of a semi-circular shape. While a rectangular shape, a triangular shape, or some other shape may be utilized to further distinguish the outward appearance of the bag, a semicircular shape is preferred to enhance the carryable volume and to otherwise provide for a convenient carry bag 10.

It should be appreciated that because each of the first portions 50 of the ends 14 are attached at the centerline 40 of the flexible outer shell 12, the flexible outer shell may be folded therealong from an open position as shown in FIG. 2 to a closed position as shown in FIG. 1 and vice versa.

A significant feature of the present invention is that the flexible outer shell 12 may be comprised of a single sheet of a cloth fabric, or the like, which may be laid out in a flat configuration and later formed into the flexible outer shell as shown by attaching the end pieces thereto.

Hence, although separate pieces of material may be utilized in the fabrication of the flexible outer shell, the preferred single piece outer shell provides significant manufacturing advantage.

As is apparent from the FIG. 1, when the flexible outer shell 12 is folded along the centerline 40 to a closed position, the transverse edges 30, 32 meet one another upon such closure, and second portions of each end piece 14 circumference meet a corresponding second portion 52 of another end piece 14 upon closure of the flexible outer shell.

Preferably, the shape of the second portion 52 of the circumference of the end pieces 14 is a straight configuration. Although it is possible for the second portion 52 of the end pieces 14 to be of a convoluted nature configured for cooperating with one another upon closure of the bag, such configuration is not shown in the figures.

In order to provide the two separate compartments 60, 62 within the carry bag 10, a pair of flexible flaps, 64, 66, may be provided with each of the flexible flaps being attached to each of the flexible outer shell transverse edges 30, 32 and having sufficient length to extend between the flexible outer shell transverse edge and the centerline 40 thereof.

The flexible flaps being hingably attached to the flexible outer shell transverse edges 30, 32 by sewing, or the like, are movable from a position extending between the flexible outer shell transverse edges 30, 32 and the centerline 40 to a position extending outwardly from the flexible outer shell transverse edges, the latter being shown in FIG. 2.

As can be clearly seen in FIG. 2, when the flap 64 and 66 are extended in positions extending outwardly from the flexible outer shell transverse edges 30, 32, easy access is provided to the compartment 60, 62, hence, clothes and items may be stacked or packed therein and arranged and identified very easily compared to prior art carry bags in which the only access to the inner compartment is by way of a zippered slot, or the like, through which the clothes and items packed within the bag cannot be readily ascertained.

In addition, because the flaps 64, 66 when folded inward toward the centerline 40 of the flexible outer shell 12, separate the compartment 60, 62 from one another, items packed in the carry bag may be effectively separated from one another as may be desired when some of the items are clean clothes and others are soiled clothes.

To further secure the separation of items placed in the separate compartments 60, 62 a plurality of flexible strips 70 may be provided, with each one being attached to each of the second circumferential portions 52 of the end pieces 14 and zippers 72 may be provided for releasably attaching the flexible strips 70 to the flexible flap 64, 66, when the flexible flaps are moved to a position extending between the flexible outer shell transverse edges 30, 32 and the centerline 40 thereof.

Figure 3:
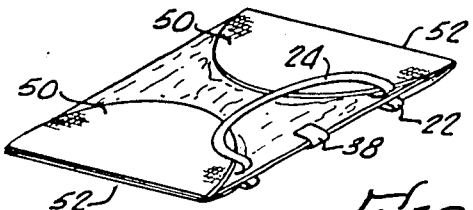

It should be appreciated that the end pieces 14 are foldably attached along the second circumferential portion 50 thereof to the flexible outer shell 12 for enabling the end pieces 14 to be folded in a generally parallel relationship with one another and against the flexible outer shell as shown in FIG. 3.

Turning again to FIG. 2, one or more pockets 80 may be attached to the flexible flaps 64, 66 by sewing, or the like, and disposed on sides 82, 84 thereof facing the inside surface 86 of the flexible outer shell 12 when the flexible flaps 64 extend between the flexible outer shell transverse edges 30, 32 and the flexible outer shell centerline 40.

In this configuration, the pockets 80 are accessible when the flaps 64, 66 are extended as shown in FIG. 2, and useable for the storage and separation of small items.

It should be apparent that when the flaps 64, 66 are folded inwardly toward the flexible outer shell centerline 40 and the bag closed, items disposed therein are confined to the compartment area 60, 62 of the carry bag when the carry bag is in a closed configuration as shown in FIG. 1.

As shown in the FIG. 1, the pockets 80 may be sewn, or disposed on opposite sides 88, 90 of the flaps 64, 66 respectively, so that access is available thereto when the flaps 64, 66 are closed to a position extending between the flexible outer shell transverse edge 30, 32 and the centerline 40, and the zippers 72 utilized to secure the flaps 64, 66 to the flexible strips 70, 72.

In this alternative configuration, not shown, it is readily apparent that the pockets 80 are accessible when the carry bag 10 is unfolded to a position shown in FIG. 2 and the flaps 64, 66 are not open to a position extending outwardly from the flexible outer shell transverse edges 30, 32.

While the flexible outer shell 12, flaps 64, 66, as well as the flexible strips 72 may be comprised of a flexible cloth fabric, or the like, the end pieces 50 may be formed from a relatively stiff material such as fabric coated plastic or multiple layers of flexible fabric, in order to cause the carry bag 10 to maintain its shape in a closed configuration as shown in FIG. 1 without a filling amount of clothes or articles in the compartments 60, 62.

To enhance the foldability of the carry bag 10, it should also be appreciated that the flexible strips 70 may be attached by sewing, or in another foldable manner, to the second circumferential portions 52 to the end pieces 14.

Although there has been hereinabove described a specific arrangement of a carry bag, in accordance with the invention, for the purposes of illustrating the manner in which the invention may be used to advantage, it should be appreciated that the invention is not limited thereto. Accordingly, any and all modifications, variations, or equivalent arrangements which may occur to those skilled in the art should be considered to be within the scope of the invention as defined in the appended claims.

What is claimed is:

1. A carry bag comprising:

a flexible outer shell foldable along a centerline thereof and having two longitudinal edges and two transverse edges, said two transverse edges being parallel to one another and to said centerline;

four rigid semicircular end pieces, one attached along each of the flexible outer shell longitudinal edges, each of said end pieces being attached along a first portion of a circumference thereof from the flexible outer shell centerline to one of the flexible outer shell transverse edges enabling the flexible outer shell to be folded along the flexible outer shell centerline to close the flexible outer shell with the flexible outer shell transverse edges meeting one another upon such closure and a second portion of each end piece circumference meeting a corresponding second portion of another end piece upon closure of the flexible outer shell, each rigid semicircular end piece being foldably attached, along the second circumferential portion thereon, to the flexible outer shell for enabling two end pieces on each end of the carry bag to fold against one another with the flexible outer shell therebetween, said rigid end pieces being attached along the second circumferential portion to enable alignment of a pair of said rigid semi-circular end pieces with one another when folded with the flexible outer shell therebetween;

a pair of flexible flaps, one each being attached to each of said flexible outer shell transverse edges and having sufficient length to extend between said flexible outer shell transverse edge and centerline, each said flexible flap being movable about the attached flexible outer shell transverse edge from a position extending between said flexible outer shell transverse edge and centerline to a position extending outwardly from said flexible outer shell transverse edges;

a plurality of flexible strips, one being attached to each of the second circumferential portion of the end pieces and to each transverse edge, each of said flexible strips engaging said centerline when said carry bag is in an open or unfolded configuration; and, zipper means for releasably attaching said flexible strips to said flexible flaps when the flexible flaps are moved to a position extending between flexible outer shell transverse edge and centerline.

2. The carry bag according to claim 1 wherein the first circumferential portion of each semi-circular end piece has an arcuate shape and the second circumferential portion of each semi-circular end piece has a generally straight shape to enable the carry bag to be collapsed into a flat generally rectangular shape.

3. The carry bag according to claim 2 further comprising handle means including a flexible cord extending around said flexible outer shell and having a first and a second portion extending outwards from the flexible bag transverse edges for carrying of said carry bag, said handle means first and second portion meeting one another when said flexible outer shell is in a closed position.

4. The carry bag according to claim 3 further comprising latch means attached proximate each of said flexible outer shell transverse edges for releasable engagement, said latch means being operative for releasably holding said flexible outer shell transverse edges against one another, thereby maintaining said flexible outer shell in a closed position.

5. The carry bag according to claim 4 wherein said flexible flaps have at least one pocket disposed on a side thereof facing an inside surface of the flexible outer shell when the flexible flaps extend between said flexible outer shell transverse edge and centerline.

6. The carry bag according to claim 5 further comprising means for releasably attaching said first and second portion of said flexible cord to one another when said flexible outer shell is in a closed position.

7. The carry bag according to claim 6 wherein said flexible outer shell, flexible strips and flaps are comprised of a cloth fabric.

* * * * *